US005451836A

United States Patent [19]

Barry et al.

[11] Patent Number: 5,451,836

[45] Date of Patent: Sep. 19, 1995

[54] THYRATRON WITH ANNULAR KEEP-ALIVE ELECTRODE

[75] Inventors: Jonathan D. Barry, Williamsport; Todd A. Clymer, Trout Run, both of Pa.

[73] Assignee: Litton Systems, Inc., Beverly Hills, Calif.

[21] Appl. No.: 99,212

[22] Filed: Jul. 29, 1993

[51] Int. Cl.[6] ..... H01J 17/04; H01J 17/54

[52] U.S. Cl. ..... 313/581; 313/161; 313/231.31; 313/359.1; 313/590; 313/592; 315/344; 315/111.31

[58] Field of Search ..... 313/161, 581, 589, 590, 313/592, 593, 613, 574, 631, 231.71, 293, 303, 306, 308, 310, 359.1, 231.31, 231.41; 315/73, 63, 111.21, 111.81, 362, 348, 111.31, 344; 337/22, 25, 34, 114, 306

[56] References Cited

U.S. PATENT DOCUMENTS

| | | | |
|---|---|---|---|
| 3,005,924 | 5/1959 | Reilly et al. | 313/595 |
| 3,110,834 | 11/1963 | Schneider et al. | 313/593 X |
| 3,327,166 | 6/1967 | Gordon | 313/592 X |
| 4,123,684 | 10/1978 | Menown et al. | 313/592 |
| 5,132,597 | 7/1992 | Goebel et al. | 313/161 |

FOREIGN PATENT DOCUMENTS

| | | | |
|---|---|---|---|
| 445593 | 4/1936 | United Kingdom . | |
| 966501 | 8/1964 | United Kingdom . | |
| 1518360 | 7/1978 | United Kingdom . | |
| 1583493 | 1/1981 | United Kingdom . | |
| 2065962 | 7/1981 | United Kingdom | 313/593 |
| 2125613 | 3/1984 | United Kingdom . | |

OTHER PUBLICATIONS

Goldberg, S., *Research Study on Hydrogen Thyratrons*–vol. II, p. 16, Edgerton, Germeshausen & Grier, Boston (1956).

Burkes, T. R. (ed.), "General Switching Considerations", *Gas Discharge Closing Switches*, pp. 1–13, Plenum Press, New York (1990).

Gundersen, Martin (ed.), "Thyratrons", *Gas Discharge Closing Switches*, pp. 375–377, Plenum Press, New York (1990).

Creedon, John, "Design Principles and Operation Characteristics", *Gas Discharge Closing Switches*, pp. 379–405, Plenum Press, New York (1990).

Menown, H. et al., "Hydrogen Thyratrons and Their Applications as Developed in the UK", *Gas Discharge Closing Switches*, pp. 409–427, Plenum Press, New York (1990).

Erwin, D. A. et al., "Studies of Fundamental Processes in Thyratrons", *Gas Discharge Closing Switches*, pp. 429–450, Plenum Press, New York (1990).

Penetrante, B. M. et al., "Fundamental Limitations of Hydrogen Thyratron Discharges", *Gas Discharge Closing Switches*, pp. 451–472, Plenum Press, New York (1990).

*Primary Examiner*—Sandra L. O'Shea
*Assistant Examiner*—Ashok Patel
*Attorney, Agent, or Firm*—Nilsson, Wurst and Green

[57] ABSTRACT

A thyratron has an auxiliary "keep-alive" electrode in the form of a surface element with at least one aperture therein. In a preferred embodiment, the auxiliary electrode is disposed adjacent the upper end of a heat shield surrounding the cathode of the thyratron and is preferably coplanar with the upper end of the heat shield. A baffle can also be provided between the auxiliary electrode and the cathode to enhance control of the thyratron's switching action.

12 Claims, 2 Drawing Sheets

THYRATRON WITH ANNULAR KEEP-ALIVE ELECTRODE

BACKGROUND OF THE INVENTION

The present invention relates to a gas discharge closing switch and, more particularly, to a hydrogen thyratron having an annular keep-alive structure.

Gas discharge closing switches, such as thyratrons, are used for rapid switching of high power signals with low power consumption. A typical thyratron has an anode connected to high voltage and a cathode held at ground potential. A control electrode or "grid" is placed between the anode and the cathode which, upon application of a positive control pulse, closes the switch by drawing electrons from the cathode to transform gas within the device into a dense, conducting plasma in an avalanche process.

In order to facilitate breakdown of the gas into a conductive plasma, it is desirable to provide a localized pool of charge carriers within the device on a continuous basis. This is done by pre-ionizing a portion of the gas within the device, typically using a low power DC discharge between an auxiliary "keep-alive" electrode and the cathode itself. The resulting pool of carriers, made up of both ions and electrons, is referred to as a "keep-alive plasma". It dramatically improves (decreases) the rise time of the cathode current and thereby prolongs the life of the device.

One prior form of auxiliary electrode is a wire ring located just inside the side wall of a cathode heat shield. Such electrodes are rather inefficient, however, because the keep-alive plasma is not in line with the field from the control electrode and therefore is not located in the region of ultimate gas breakdown, i.e., any region in the direct path of current flow during conduction. Consequently, the charged particles of the keep-alive plasma are less readily available to perform their function.

Another auxiliary electrode is a solid disk disposed within an aperture at the end of a cathode heat shield. This structure, disclosed in U.S. Pat. No. 4,123,684 to Menown et al., provides a localized keep-alive plasma in the vicinity of the electrode. It suffers, however, from the fact that all of the current through the device must pass through a relatively small space between the disk and the heat shield, which may limit the maximum peak current capability of the thyratron.

Yet another auxiliary electrode structure is disclosed at page II-16 of Research Study on Hydrogen Thyratrons-Vol. II (1956) (authors unknown). The auxiliary electrode is shown near a control electrode, remote from the cathode and its heat shield, for generating a "triggering plasma". Although the structure of the electrode is not entirely clear from the publication, it is apparently used to generate a keep-alive plasma over a relatively large region between the control electrode and the cathode. Unfortunately, this arrangement generates a rather low density plasma, providing relatively few carriers to facilitate breakdown when the control electrode is pulsed. In addition, a large negative bias must be applied to the control electrode to prevent the keep-alive plasma from causing premature breakdown in the anode region. This arises from the fact that the charged particles of the keep-alive plasma are not localized to the region where they are needed.

Therefore, it is desirable in many applications to provide a structure for maintaining a keep-alive plasma localized to the area of ultimate breakdown without restricting the flow of current after breakdown.

SUMMARY OF THE INVENTION

In a preferred embodiment, the present invention provides an advantageous thyratron structure in which an auxiliary electrode in the form of a surface element has at least one aperture and is positioned near the upper end of a cathode heat shield. A strong electric field is provided between the periphery of the auxiliary electrode and the heat shield to generate a relatively dense keep-alive plasma localized in the path of ultimate current flow. This localized plasma facilitates closure of the switch without risking breakdown in the anode region. The aperture in the auxiliary electrode allows a clear path for current flow when the switch is closed. The auxiliary electrode also serves as a cathode baffle which prevents evaporation of emissive cathode coating into the grid/anode region. A secondary baffle may be provided, as well, to eliminate any direct evaporation path between the cathode and the grid/anode region.

Accordingly, a thyratron constructed according to the present invention includes: a housing having at least one cavity; an anode structure and a cathode structure within the cavity; a control electrode disposed between the anode structure and the cathode structure; and an auxiliary electrode disposed between the control electrode and the cathode structure, the auxiliary electrode comprising a surface element having at least one aperture therethrough. In a preferred embodiment, the thyratron includes a heat shield disposed about the cathode structure and terminating in an upper end facing the anode structure, and the auxiliary electrode is adjacent the upper end. The auxiliary electrode may be substantially coplanar with the upper end of the heat shield, which itself may have an inwardly-directed flange portion. In another embodiment, the thyratron may include at least one baffle located within the heat shield at a location between the auxiliary electrode and the cathode.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
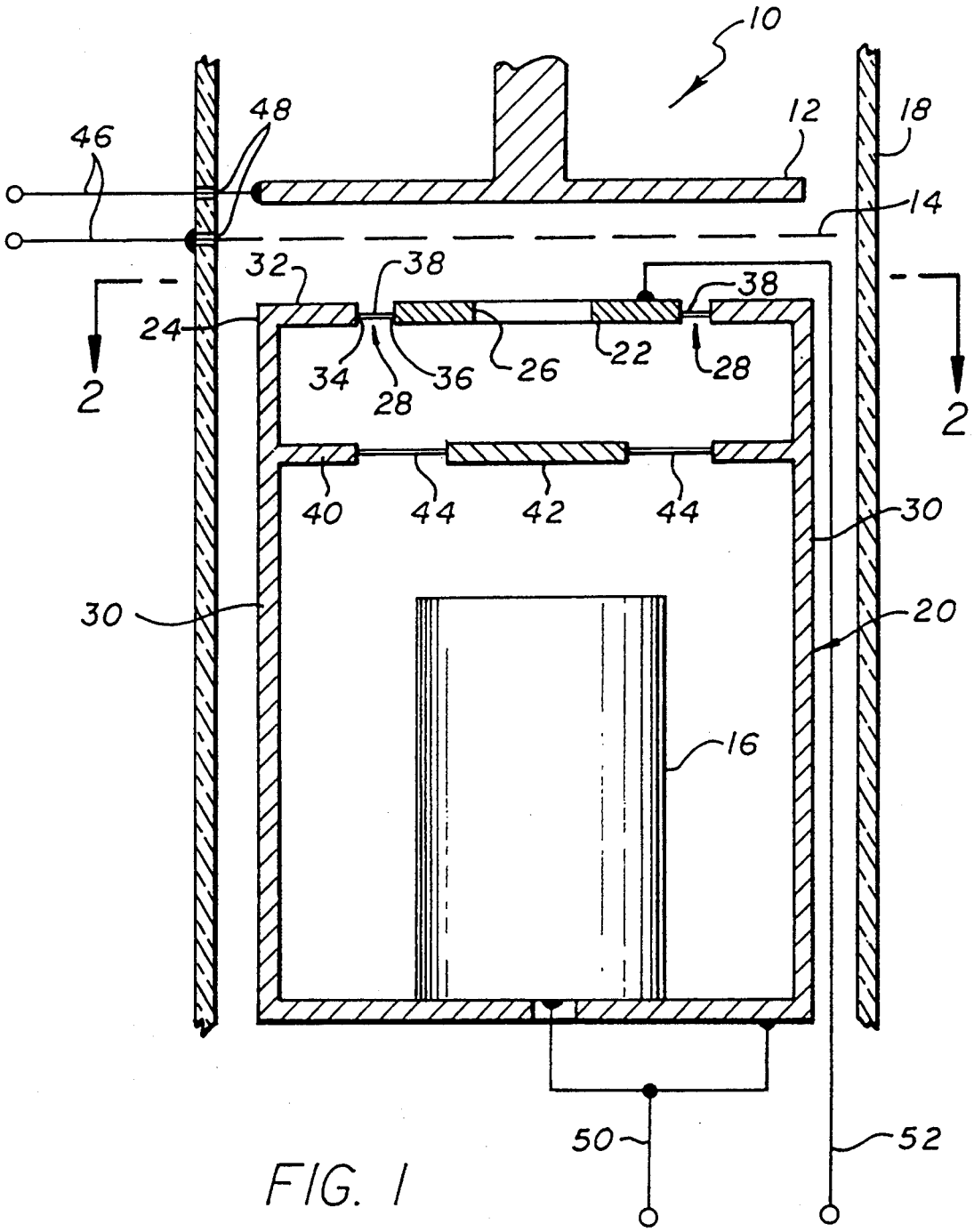
FIG. 1 is a fragmentary partial sectional view of a thyratron constructed according to one embodiment of the present invention.
Figure 2:
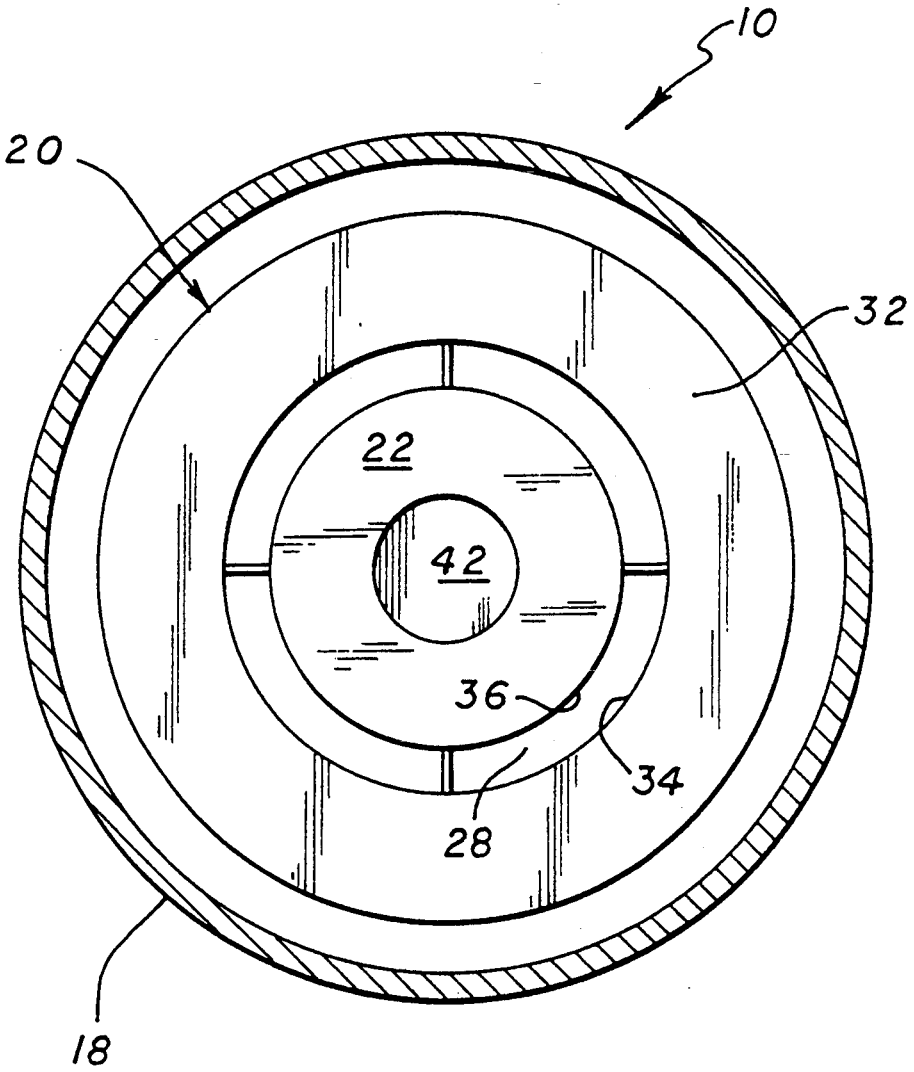
FIG. 2 is a horizontal sectional view taken along the line 2—2 of FIG. 1.

Referring to FIGS. 1 and 2, a thyratron or other gas discharge closing switch 10 constructed in accordance with the present invention has an anode 12, a control electrode or "grid" 14, and a cathode 16, all of which are located within a gas-filled housing 18. A heat shield 20, disposed within the housing 18 and surrounding the cathode 16, has an auxiliary electrode 22 at its upper end 24.

The auxiliary electrode is a substantially flat annular surface element which has a central opening 26 and is spaced from the heat shield 20 by a relatively small gap 28. A voltage is applied to the auxiliary electrode 22 on a constant basis in order to create a localized plasma in the region of the gap 28 and thereby facilitate closure of the thyratron switch in response to a positive pulse applied to the grid 14. The central opening 26 provides a clear path for conduction of current between the anode 12 and the cathode 16 when the switch is closed, and the auxiliary electrode 22 acts as a baffle to prevent evaporation of emissive coating from the cathode to the grid/anode region.

In the illustrated embodiment, the cathode 16 is cylindrical and the heat shield 20 has a cylindrical side wall 30 disposed about the cathode. The side wall 30 has an inwardly directed annular flange 32 at its upper end 24 near the auxiliary electrode 22. The annular flange 32 is preferably coplanar with the auxiliary electrode and has an inner edge 34 spaced from an outer edge 36 of the auxiliary electrode to form the gap 28. The auxiliary electrode is supported relative to the annular flange 32 by a plurality of insulating members 38 so that a "keep-alive" potential can be applied to it. In this configuration, the inwardly-directed flange 32 also acts as a baffle.

The cylindrical side walls 30 of the heat shield 20 may also have a second inwardly directed annular flange 40 located below the annular flange 32 to act as a second baffle. A central disk-shaped baffle 42 is then preferably supported by and aligned with the annular flange 40 at a point beneath the central opening 26 of the auxiliary electrode. The central baffle 42 is supported relative to the flange 40 (or, in the absence of a flange 40, relative to the cylindrical side wall 30 of the heat shield) through a plurality of support arms 44. The support arms 44 are preferably electrically conductive so that the disk-shaped baffle 42 is maintained at the same potential as the heat shield 20.

Electrical connection is made to the anode 12 and the control electrode 14 by respective leads 46 extending through the wall of the housing 18 by way of gas-tight feed-through fittings 48. Likewise, the cathode 16 and the heat shield 20 are typically grounded through a lead 50, and a relatively small DC potential is applied to the auxiliary electrode 22 through a separate lead 52. The leads 50 and 52 also pass through the walls of the housing 18 for external electrical connection (not shown).

The housing 18 is, of course, filled with a suitable plasma-forming gas, such as hydrogen gas, and is then sealed off from the atmosphere. A suitable gas reservoir (not shown) of conventional design is also provided within the housing to maintain the gas pressure at a preselected optimum level.

In operation, a high voltage is applied to the anode 12 and both the cathode 16 and the heat shield 20 are grounded. At the same time, a constant DC voltage is applied to the auxiliary electrode 22 to produce a relatively high density, but very localized, "keep-alive" discharge in the annular gap 28 between the auxiliary electrode 22 and the flange 32 of the heat shield 20, as well as in the region between the auxiliary electrode and the cathode. This discharge provides a constant source of charged species to aid in breakdown of the gas when the thyratron "fires". Before firing, the control electrode 14 is typically maintained at ground potential, or preferably a negative potential, to repel electrons emanating from the auxiliary electrode 12 or the cathode itself. The auxiliary electrode 22 therefore keeps the gas slightly energized and ready for switch closure. Closure occurs when a positive pulse is applied to the control electrode 14. Such a pulse attracts electrons from the cathode 16, which is preferably coated with a thermionic coating and heated to a temperature of approximately 800° C., and acts to move the charge carriers from the keep-alive plasma. As the electrons and other charge carriers travel through the gas, they collide with gas molecules and set up an avalanche which results in a dense conducting plasma throughout the interior of the housing 18. This process is facilitated by the keep-alive plasma, enhancing the rise time of the thyratron current and smoothing the voltage gradient across the device. The useful life of the device thereby increases dramatically when a keep-alive plasma is present.

The thyratron 10 returns to its nonconducting state only when the anode voltage is removed for a time sufficient to allow the charged particles of the plasma to recombine. This period is known as the "recovery time" of the device. The grid potential then returns to its original (typically negative) value and a positive voltage can be applied to the anode without conduction taking place. The keep-alive potential is also re-applied to the auxiliary electrode 22 at this time to maintain the thyratron in a condition suitable for firing upon the next positive control pulse.

The structure and placement of the auxiliary electrode 22 also causes it to act as a cathode baffle between the anode 12 and the cathode 16, facilitating precise control of the thyratron, without impeding the flow of current in the closed state of the device. At the same time, the substantially flat geometry of the auxiliary electrode helps dissipate heat that develops during breakdown of the gas. Of course, the auxiliary electrode 22 need not be planar. It can be contoured as long as it continues to have a central opening and remains close to the upper end of the heat shield. In addition, the auxiliary electrode 22, the cathode heat shield 20 and the cathode 16 need not be cylindrical, as illustrated in FIGS. 1 and 2, as long as they are symmetrical about the axis of the device. For example, they can be square or elliptical in cross-section, if desired.

Although the dimensions and other parameters of the thyratron 10 can vary widely depending on application, the following parameters have been found to be particularly advantageous:

| | |
|---|---|
| gap 28 between auxiliary electrode and heat shield | .125 inches |
| anode voltage (typical) | 20–40 KV |
| bias of control electrode 14 before firing | −70 volts |
| positive pulse applied to control electrode 14 to "fire" the thyratron | 500–2000 volts |
| "keep-alive" potential applied to auxiliary electrode 22 | 75–150 volts DC |

From the above, it can be seen that the keep-alive structure of the present invention permits the primary circuit of the thyratron 10 to be closed rapidly and efficiently without restricting the freedom of charged particles to pass between the anode and the cathode in the closed condition.

While certain specific embodiments have been disclosed as typical, the invention is not limited to these particular forms, but rather is applicable broadly to all such variations as fall within the scope of the appended claims.

What is claimed is:

1. A thyratron comprising:

an anode structure, a cathode structure and a heat shield, the heat shield disposed about the cathode structure and terminating in an upper end facing the anode structure;

a control electrode disposed between the anode structure and the cathode structure;

an auxiliary electrode adjacent the upper end of the heat shield, the auxiliary electrode comprising a surface element having at least one aperture therethrough; and said surface element of the auxiliary electrode being substantially coplanar with the upper end of the heat shield.

2. The thyratron of claim 1 wherein:

the heat shield comprises a flange at said upper end.

3. The thyratron of claim 2 which further comprises:

at least one baffle structure disposed between the auxiliary electrode and the cathode structure.

4. The thyratron of claim 1 wherein:

the auxiliary electrode has an annular shape.

5. The thyratron of claim 1 wherein:

the cathode structure and the surface element of the auxiliary electrode are axisymmetrical about a common axis.

6. The thyratron of claim 1 wherein:

said at least one aperture extends through the center of the surface element.

7. The thyratron of claim 1 wherein:

the cathode structure utilizes an electron-emitting material.

8. The thyratron of claim 7 wherein:

said electron-emitting material is thermionic.

9. The thyratron of claim 1 which further comprises:

at least one baffle structure disposed between the auxiliary electrode and the cathode structure.

10. A thyratron comprising:

a housing defining at least one cavity;

an anode structure, a cathode structure and a heat shield within the cavity, the heat shield disposed about the cathode structure and terminating in an upper end facing the anode structure;

a control electrode disposed between the anode structure and the cathode structure;

at least one baffle structure between the control electrode and the cathode structure;

an auxiliary keep-alive electrode disposed between the control electrode and said at least one baffle structure, the auxiliary electrode comprising a surface element having at least one aperture therethrough; and the surface element of the auxiliary electrode being substantially coplanar with the upper end of the heat shield.

11. A thyratron comprising:

a housing defining at least one cavity;

an anode structure, a cathode structure and a heat shield within the cavity, the heat shield disposed about the cathode structure and terminating in an upper end facing the anode structure;

a control electrode disposed between the anode structure and the cathode structure;

at least one baffle structure between the control electrode and the cathode structure;

an auxiliary electrode disposed between the control electrode and said at least one baffle structure, the auxiliary electrode comprising a surface element having at least one central aperture;

said baffle structure is aligned with said aperture, and said surface element of the auxiliary electrode being substantially coplanar with the upper end of the heat shield.

12. The thyratron of claim 11 wherein:

said baffle comprises a flat disc-like element.

* * * * *